US012630981B2

(12) United States Patent
Akira Bonk

(10) Patent No.: US 12,630,981 B2
(45) Date of Patent: May 19, 2026

(54) RAILROAD RAIL PROFILE

(71) Applicant: Paulo Akira Bonk, Sao Paulo (BR)

(72) Inventor: Paulo Akira Bonk, Sao Paulo (BR)

( * ) Notice: Subject to any disclaimer, the term of this patent is extended or adjusted under 35 U.S.C. 154(b) by 828 days.

(21) Appl. No.: 17/760,244

(22) PCT Filed: Mar. 24, 2022

(86) PCT No.: PCT/BR2022/050105

§ 371 (c)(1),
(2) Date: Aug. 5, 2022

(87) PCT Pub. No.: WO2023/178393

PCT Pub. Date: Sep. 28, 2023

(65) Prior Publication Data

US 2024/0183113 A1 Jun. 6, 2024

(51) Int. Cl.
*E01B 5/02* (2006.01)

(52) U.S. Cl.
CPC ..... *E01B 5/02* (2013.01)

(58) Field of Classification Search
CPC ..... E01B 5/00; E01B 5/02
See application file for complete search history.

(56) References Cited

U.S. PATENT DOCUMENTS

| | | | | |
|---|---|---|---|---|
| 469,392 | A | 2/1892 | Price | |
| 477,690 | A | 6/1892 | Moxham | |
| 500,688 | A | 7/1893 | Esmond | |
| 531,290 | A | 12/1894 | Devlin | |
| 871,232 | A | 11/1907 | Morse | |
| 918,640 | A | 4/1909 | Allison | |
| 1,125,748 | A | 1/1915 | Slick | |
| 1,173,596 | A * | 2/1916 | Maltby | E01B 5/02 238/128 |
| 3,201,046 | A | 8/1965 | Ferguson | |
| 3,291,394 | A | 12/1966 | Wheeler | |
| 3,525,472 | A | 8/1970 | Sato | |
| 4,775,103 | A | 10/1988 | Ortwein | |

(Continued)

FOREIGN PATENT DOCUMENTS

| | | |
|---|---|---|
| CN | 2292829 Y | 9/1998 |
| CN | 2789309 Y | 6/2006 |

(Continued)

OTHER PUBLICATIONS

International Search Report for corresponding application PCT/BR2022/050105 dated Dec. 29, 2022 and English translation (7 pages).

*Primary Examiner* — Robert J McCarry, Jr.
(74) *Attorney, Agent, or Firm* — LUCAS & MERCANTI, LLP

(57) ABSTRACT

A profile for the composition of a railroad rail with the provision for at least one pair of webs in each profile of the rail, in addition to being provided with a set of cutouts of a plurality of geometric shapes that allow the crossing of wires and cables for several purposes. The webs arranged more laterally to the center of the rail provide greater stability to the rail the plurality of holes enables greater capacity to absorb stresses and vibrations, consequently, greater stability for the train, especially at high speeds. The adopted geometries also present a greater mechanical strength in relation to common rail profiles compared to the same amount of used material.

29 Claims, 17 Drawing Sheets

(56) References Cited

U.S. PATENT DOCUMENTS

| | | | | |
|---|---|---|---|---|
| 4,801,083 | A | 1/1989 | Arteaga et al. | |
| 5,165,598 | A | 11/1992 | Ortwein | |
| 5,526,755 | A * | 6/1996 | Dalrymple | B61C 15/04 238/142 |
| 6,402,044 | B1 | 6/2002 | Sato | |

FOREIGN PATENT DOCUMENTS

| | | | |
|---|---|---|---|
| CN | 102330390 | A | 1/2012 |
| CN | 202595583 | U | 12/2012 |
| CN | 204435124 | U | 7/2015 |
| DE | 4000992 | A1 | 7/1991 |
| EP | 0013313 | A1 | 7/1980 |
| EP | 1524365 | A1 | 4/2005 |
| GB | 868598 | A | 5/1961 |
| WO | 0055426 | A2 | 9/2000 |

* cited by examiner

A

B

RAILROAD RAIL PROFILE

CROSS REFERENCE TO RELATED APPLICATION

This Application is a 371 of PCT/BR2022/050105 filed on Mar. 24, 2022, the content of which is incorporated herein by reference.

TECHNICAL FIELD

The present invention relates to improvements in railroad rail profile of the type laid and fixed on ties for track rolling surface composition, where, notably, said profile includes technical innovations that include a triple or double web conformation in order to improve the stability of the rail and, consequently, the performance of the vehicles for the rail transport, as well as, provides holes in said webs that allow the crossing of diverse wirings or cables.

BACKGROUNDS OF THE ART

Currently, rail transport is the form of land transport with the highest cargo capacity, transporting people or diverse cargo such as bulk cargo, minerals, agricultural products, animal products, unified goods, ferrous materials, liquid bulk cargo such as oil, gasoline, liquid nitrogen, among others.

For the proper locomotion of railroad vehicles, it is important that the rail presents the ideal conditions of shape and strength to withstand the loads imposed by the wheels of the train, ensuring its safe movement.

In general, railroad rails comprise steel bars or beams whose basic profile is 'Vignole' type consisting of foot, web and head as defined by NBR 7590 and NBR 7650. Namely, for example, NBR 7650 defines head as the part of the rail intended for the support and displacement of the railroad wheel and web as the part of the rail between the head and the foot, which, in turn, is defined as the base of the rail constituted by the longest mass of the double 'T', through which the rail is supported and fixed to the ties.

It turns out that the existing rail profiles have a pre-defined load capacity to be transported, restricting the passage of trains and similar vehicles with greater load in relation to the weight originally intended for the rail. In this way, if it is used by a heavier vehicle, it will imply a reduction in the speed performance of the train.

Another limitation of the usual railroad rail profiles lies in the fact that they present less stability for trains in curves, causing the need of reducing the speed in curves for the composition and less stability for trains at high speeds, resulting, in this way, in higher fuel consumption.

Another drawback of conventional railroad rail profiles lies in the fact that the same rail geometry cannot be used for light loads, usually passenger cars, and heavy loads. Accordingly, a variety of single web models is needed, which vary according to their weight per meter of length, such as, for example: the TR-25 for 24.6 kg/m; TR-32 for 32.0 kg/m; TR-37 for 37.1 kg/m; TR-45 for 44.6 kg/m and others; wherein each is made to support a specific load.

Another limitation lies in the environmental impact generated by the constant change of railroad rail profiles damaged by excess weight of loads, generating a higher cost and excessive expenditure of natural resources over time.

STATE OF THE ART

The current state of the art has documents referring to the railroad rail profile, such as the document PI 9406964-6, which addresses to a rail for use on a railroad that has a section, a head having a transport surface of traffic and a base, wherein the head comprises a traffic transport surface that is composed of low carbon martensite.

Document CN 102330390 refers to a railroad rail that presents a shock-absorbing layer, ties, blocking walls and combined rails, in which there is a part of rail sleeves and a rail beam, and the rail is firmly connected to the rail rising beam.

Document CN 202595583 comprises a guide rail for continuous casting rails that aims at improving the lubricating property between the guide rail and the rollers to reduce abrasion, said rail includes a left side wall and a right side wall, and grooves to contain lubricant are arranged in positions, which are contacted with the rollers, of the left side wall and the right side wall, as the grooves are arranged in the surfaces, which are contacted with the rollers, of the guide rail, and the grooves are filled with the lubricant, the loss caused by rolling friction is reduced and the life of the guide rail and rollers is extended.

Document CN 2292829 discloses a new form of train rail in which it comprises not only the rail, but a set of components directly coupled to the rail, a support and a structure coupled below said support that need to be associated so that the proposed invention works, as can be seen in FIG. 1 of said application. In its turn, the present invention comprises a train rail with a double or triple web, which is applied on ties similarly to the conventional rail, not requiring any additional components installed under the tie. In addition, the geometry of the rail (6) disclosed in the Chinese document is different from that disclosed in the present application. Thus, the prior art is not able to provide the same advantages proposed by the present invention.

Document CN 2789309 describes a kind of rail support consisting of two components that are fixed along the web of the rail to reduce the vibration of the rail generated by the train. When applied to the rail, the support is positioned along the web so that the support does not touch the ground. Thus, the invention proposed in the Chinese document does not suggest a new form of rail with double or triple web capable of offering greater stability to the rail when subjected to loading.

Document U.S. Pat. No. 469,392 describes a train rail with a double web, which may or may not have a wood positioned between the webs and on which the rail components are mounted. Despite having two webs, said document does not disclose any indication of a rail with the features and advantages proposed by the present invention. Furthermore, considering the substantial time interval since the filing of said American document, there would be no way for inventors to envision the same technical problem as the present invention.

Document U.S. Pat. No. 500,688 describes a plurality of train rails with purposes that comprise from rails that keep the head at the same height of the surface on which it is installed, rails with double heads to rails with lateral supports to avoid bending the web. Therefore, the matter disclosed in that document does not suggest or envision a rail with a double or triple web, installed in the same way as conventional rails and wherein they aim at increasing the strength of the rail using a smaller amount of material and provide greater stability to the rail. Furthermore, considering the filing date of document U.S. Pat. No. 500,688, it would not be possible to envision the same technical problem as the focus of the present application.

Document U.S. Pat. No. 871,232 describes a train rail support fixed to the web by means of screws in order to dispense with the use of ties. Therefore, the document does not disclose or teach the creation of a double or triple web train rail that offers greater strength and stability. Additionally, considering filing date of the aforementioned document, it would not be possible to envision the same technical problem as the focus of this application.

Document U.S. Pat. No. 918,640 describes a train rail consisting of insertable elements, wherein it presents a triple web. Although the invention disclosed in the prior art also uses a triple web, the arrangement adopted with the side webs (4) extending from the base (1) to the central web (3) following an inclined plane does not provide the same strength and stability as the present invention promotes; this understanding is based on the way that the loads attributed to the head converge at the meeting point of the webs, which, depending on the position of the loading in the head, makes the lateral webs (4) work under a regime predominantly of flexure, while the lateral webs of the present invention, under the same load, work under a compression regime.

Document WO 00/55426 describes a method for the construction of rails that comprises a set of elastic elements that are fixed together with the train rail; therefore, said document does not disclose or suggest a train rail with a double or triple web with the same proposed advantages as the present invention.

Finally, no document discloses a similar technology and with the same advantages proposed by the present invention.

BRIEF DESCRIPTION OF THE INVENTION

The present invention comprises a profile for the composition of a railroad rail with provision for at least one pair of webs in each rail profile, in addition to being able to be provided with a set of cutouts of a plurality of geometric shapes that allow the crossing of wires and cables for diverse purposes. The webs arranged more laterally to the center of the rail provide greater stability to the rail. And the plurality of holes enables greater capacity to absorb stresses vibrations, consequently, greater stability for the train, especially at high speeds, in addition to serving as a mooring point for transporting the rails.

The adopted geometries also present a greater mechanical strength in relation to the common rail profiles compared to the same amount of used material.

BRIEF DESCRIPTION OF FIGURES

In order to obtain a better understanding of the features of the present invention and according to a preferential practical embodiment of the same, the attached description is accompanied by a set of drawings, where, in an exemplified way, although not limiting, its operation was represented:

FIG. 2 shows a side view of a section of the rail in FIG. 1, illustrating some models of holes or cutouts for crossing cables and various wirings, as well as helping to reduce vibration, in which

FIG. 3 shows the cross-section front view of the triple web rail;

FIG. 4 shows the cross-section front view of the triple web rail, in which the section plane passes through the holes in the webs;

FIG. 5 represents a perspective view of a second version of the innovative profile, in this case, a double web profile for railroad rails.

DETAILED DESCRIPTION OF THE INVENTION

Figure 1:
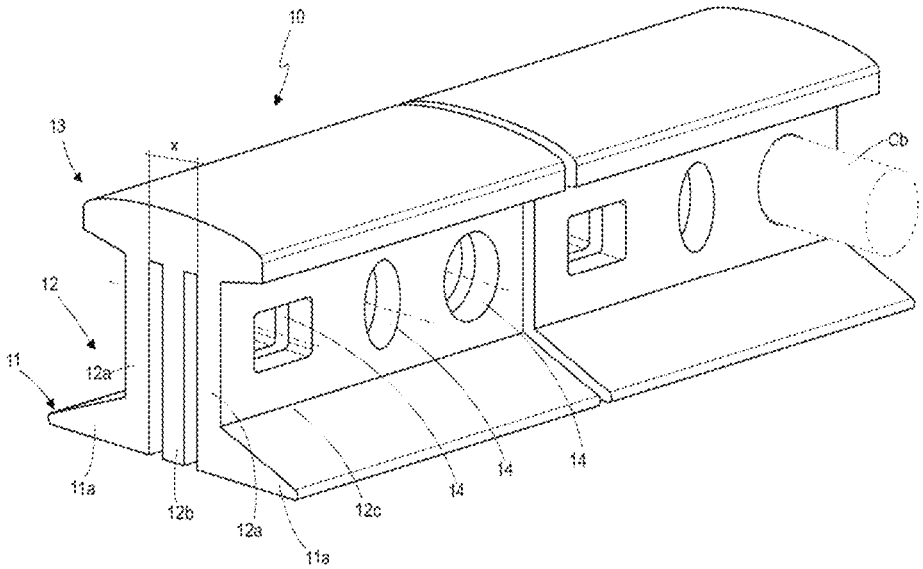
FIG. 1 represents a perspective view of a first version of the innovative triple web profile for a railroad rail.
Figure 2:
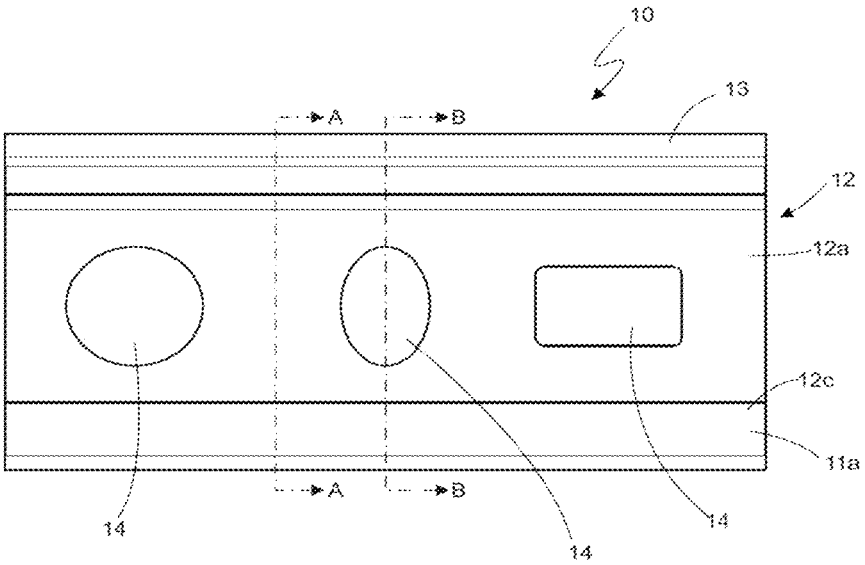
Figure 3:
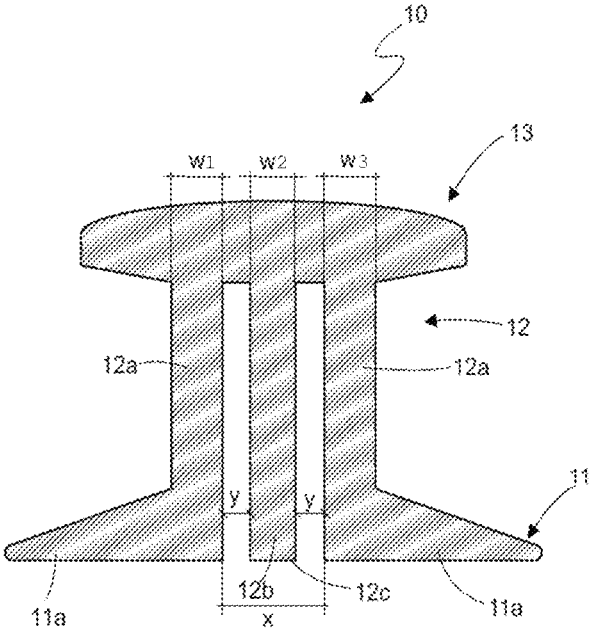
FIGS. 3 and 4 and 5 represent cross sections, as indicated in the previous figures.
Figure 4:
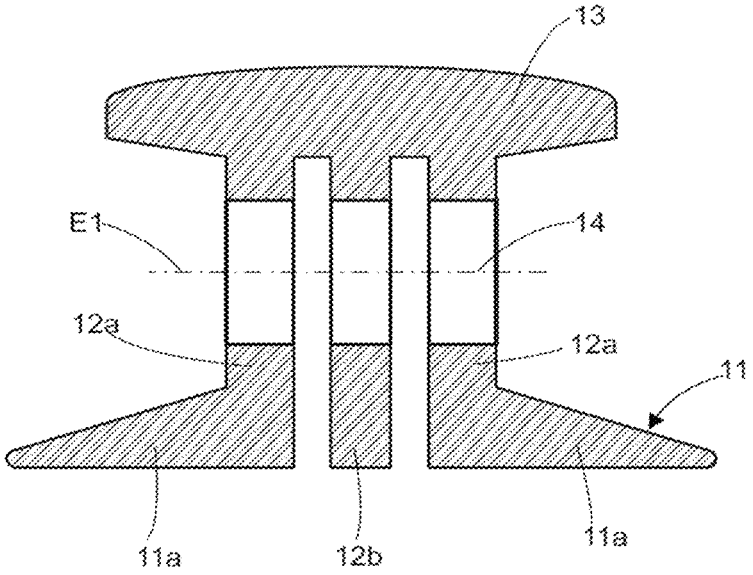
Figure 5:
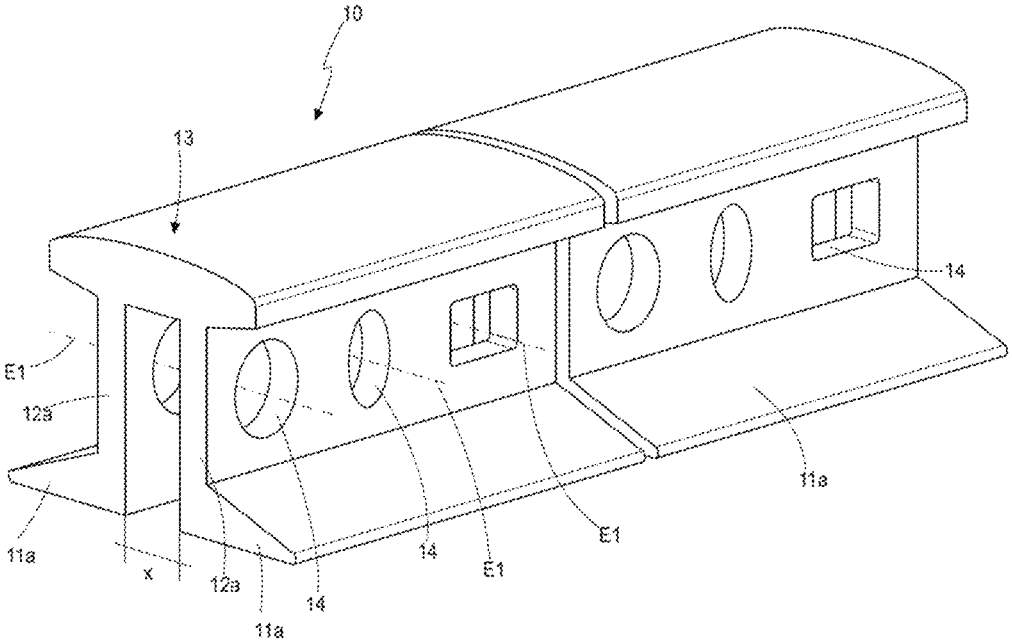
Figure 6:
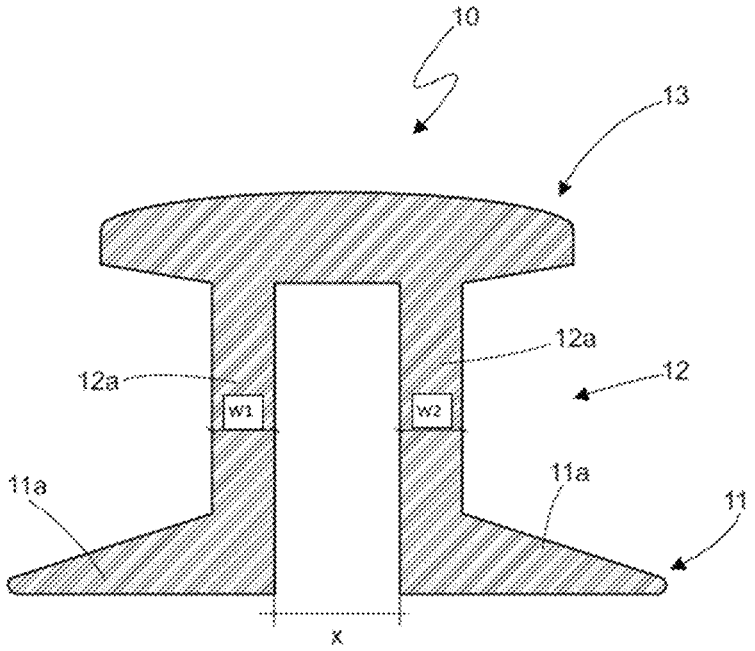
FIGS. 6 and 7 represent cross-sections performed on the rail of FIG. 5, showing the section of the double web in an integral way and another section of the double web provided with cutouts or holes.
Figure 7:
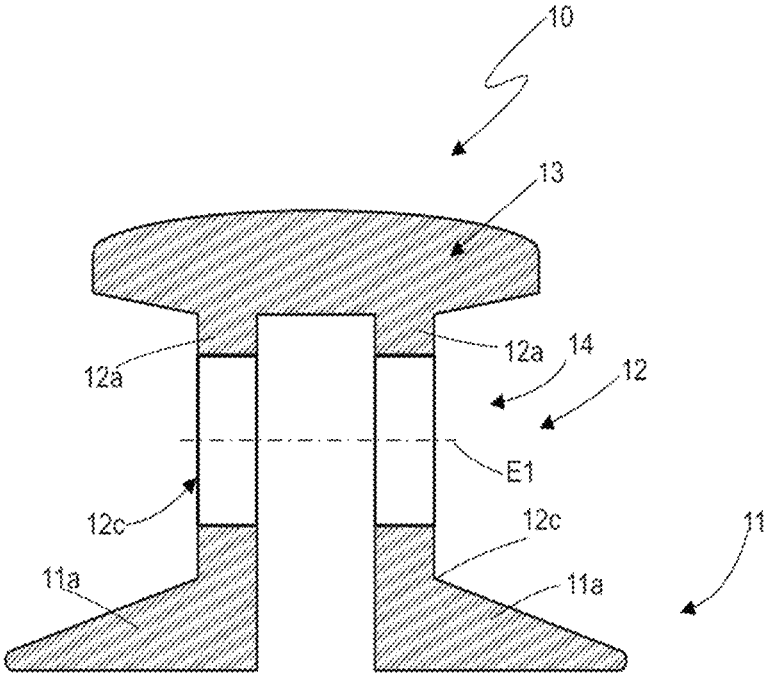

With reference to the illustrated drawings, the present invention comprises a railroad rail profile (10) of the type for laying and fixing on ties (not illustrated) for track rolling surface composition. Said profile (10) is made of steel or other similar material and consists of a foot (11), a web (12) and a head (13).

The profile (10) provides in a first embodiment that the web (12) is formed by two parallel walls (12*a*) with thicknesses $W_1$ and $W_2$, and in a second embodiment, in which the profile (10) presents an arrangement of a central wall (12*b*) with thickness $W_2$ and two walls (12*a*) with thicknesses $W_1$ and $W_3$, forming a rail with a triple web (12).

The profile (10), in the form of a double or triple web, has a spacing (x) between the walls (12*a*) in the range of 4 to 45 mm. The webs (12) have a thickness (w1, w2 or w3) in the range of 13 to 18 mm, being preferably 9.71 mm for double web rails and 8 mm for triple web rails. In addition, it is also provided by the present invention that the webs of the double or triple rails still have different thicknesses in the same section of said rail. This variation is interesting in curved sections, where the train loads on the rails change substantially.

In addition, the webs (12) can have uniform dimensions, that is, equal dimensions for the walls (12*a*) in the double web rails or the same dimensions for the walls (12*a*) and central wall (12*c*) in the triple web rails, or variable dimensions between the walls (12*a*) in the double web rails or between the walls (12*a*) and/or central wall (12*c*) in the triple web rails, in order to adapt the rail for different loads, such as in curved sections.

The lower ends of the walls (12*a*) of the triple web have side branches (11*a*), directed in directions opposite each other, comprising the foot (11), while the upper ends of said walls (12*a*) are joined together by a single sector comprising the head (13).

In both embodiments, the walls (12*a*) and (12*b*) can receive holes or cutouts (14) of varied geometries and aligned with each other according to the crossing axis (E1), preferably located in the center of said walls, allowing the passage of wires/cables (Cb), as well as configuring mechanical means of absorption of stresses and vibrations.

Said cutouts can (14) present varied dimensions, in the range from AA to BB, and different shapes such as circular, oblong/oval and rectangular with rounded edges, as well as being both concentric and eccentric, wherein the cutouts (14) are preferably concentric, circular or ellipsoidal.

In addition, it is clear that for a technician skilled on the subject the dimensions of the heads, feet, height and total width of the rail can be changed according to the design requirements.

In this way, the present invention proposes railroad rail embodiments that are more resistant and have the same linear weight of a conventional rail.

Therefore, those skilled in the art will value the knowledge presented herein and will be able to reproduce the invention in the presented embodiments and in other variants, encompassed by the scope of the attached claims.

EXAMPLE OF EMBODIMENT

The embodiment presented herein is not intended to act as a limitation, but to exemplify the features of the invention.

One of the embodiments comprised by the present invention is made from the features of the TR68 rail provided by NBR 7590:2012. The TR68 rail is a rail with an approximate linear weight of 68 kg/m with a height of about 185.74 mm, width of the foot (11), head (13) and web (12) of 152.4 mm, 74 mm and 17.46 mm, respectively.

The profiles (10) evaluated are double web and triple web ones, maintaining the same dimensions of the head and foot of the TR68 rail, with a height of 159.54 mm and distance between the external surfaces of the walls (12*a*) of 35.42 mm, distance X of 8 mm for double web and 16 mm for triple web, thickness $W_1$ and $W_2$ of 13.71 mm for double web and $W_1$ and $W_3$ of 9.71 mm for the walls (12*a*) and $W_3$ of 8 mm for the central wall (12*b*) of the triple web rail.

To emphasize the advantages proposed by the present invention, a mechanical simulation was performed between said TR68 rails, with double web and triple web, wherein they are made of steel with a density of 7833 $kg \cdot m^{-3}$, modulus of elasticity of 199947.953 MPa, Poisson's coefficient of 0.290, yield stress of 262.001 MPa, maximum stress of 358.527 MPa and elongation of 0.

The spacing between ties is a variable that depends on several factors and that, in this comparison, should be considered as a fixed dimension. It is calculated as a function of the allowable stress on the ballast, the tamping area, the increased wheel load and the impact coefficient. In addition, it also depends on the type of material that the tie is made of (wood, concrete, steel, etc.) and on the gauge, as shown in Table 1. In this way, the spacing adopted is 0.70 m because it is the largest spacing that will cause the greatest stresses and strains in the rail.

TABLE 1

Tie spacing.

| Tie | Gauge (m) | Spacing (m) |
|---|---|---|
| Wood | 1.0 to 1.6 | 0.54 |
| Bi-block concrete | 1.0 to 1.6 | 0.60 |
| Monoblock concrete | 1.0 to 1.6 | 0.60 to 0.70 |
| Steel | 1.0 to 1.6 | 0.54 |
| Recyclable (plastic) | 1.0 to 1.6 | — |

The dimensioning of the rail was carried out using the "simplified" Talbot method, considering the inelastic supports with a spacing of 0.70 m, regardless of the distances between the axles of the cars (the most used in Brazil are 1575 mm, 1727 mm and 1828 mm).

The value of the load applied to the rail was defined based on the largest loads used in Brazilian railroads, which is 32 ton/axle. In addition, a safety factor of 2.5 was applied, resulting in a load of 40 ton on each rail.

The rail was modeled based on the dimensions provided in NBR 7590:2012 and the length of the modeled rail was determined based on the size and spacing of the ties. As a boundary condition, the model was truncated and crimped at the ends and supported in the contact with the ties. The load application region corresponds to the contact between the train wheel and the rail.

The computational mesh used in the analysis was constituted with elements of approximately 5 mm along the entire body and 1 mm in the regions demanding greater refinement (region of the double and triple rails slots). The total number of elements varies according to the analyzed profile. Table 2 presents the information of the used mesh.

TABLE 2

Computational mesh.

| Profile | Element type | Total number of elements | Total number of nodes |
|---|---|---|---|
| TR68 | Tetrahedron | 70529 | 114295 |
| Double rail | Tetrahedron | 102448 | 165754 |
| Triple rail | Tetrahedron | 127346 | 208538 |

In this work, the behavior of the rail for loads in the vertical and horizontal directions was evaluated. The vertical load comes from the weight of the train when the train passes over the rail and the weight of the rail itself (gravitational field), causing a deflection in the vertical direction. The horizontal load is present in the system when the train makes a turn on the rails. The analyzes carried out take into account only the static loads on the structure.

Three rail profiles subjected to a vertical load were simulated. The results were analyzed in terms of maximum stresses and strains and are presented below. As it is a comparative scenario between the profiles, the maximum allowable stresses of the material were not taken into account, since the purpose of the analysis is to comparatively evaluate the profiles, highlighting the one that presents the best distribution of stresses and the smallest displacement.

Figure 8:
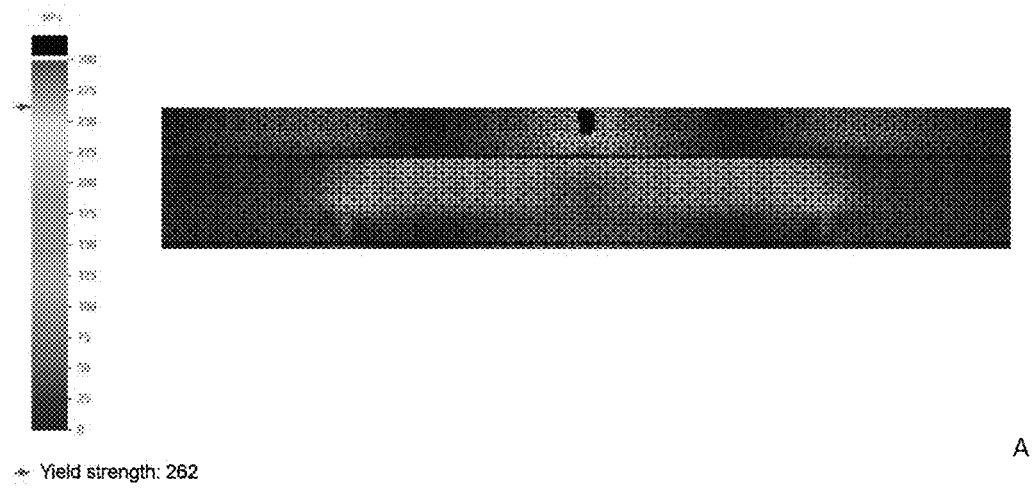
FIG. 8 shows the result of the simulations of vertical loads with maximum stresses on the TR68 rails (A), on the double web rail (B) and on the triple web rail (C)
Figure 8:
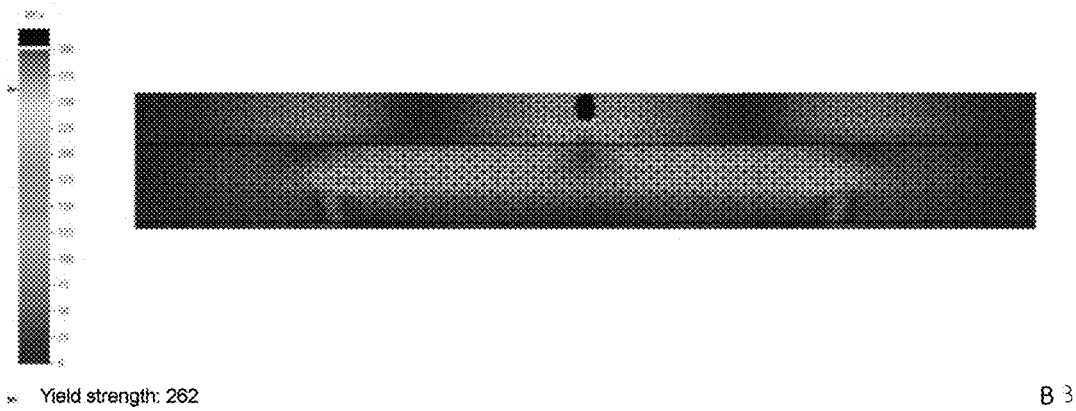
Figure 8:
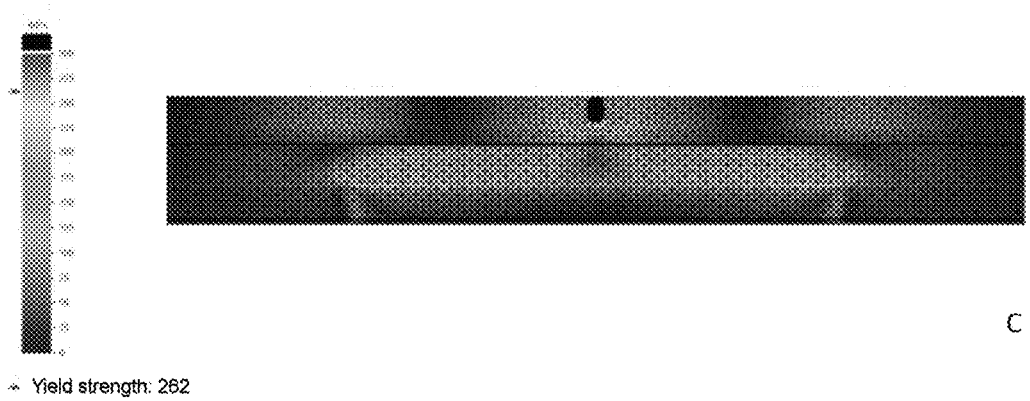
Figure 9:
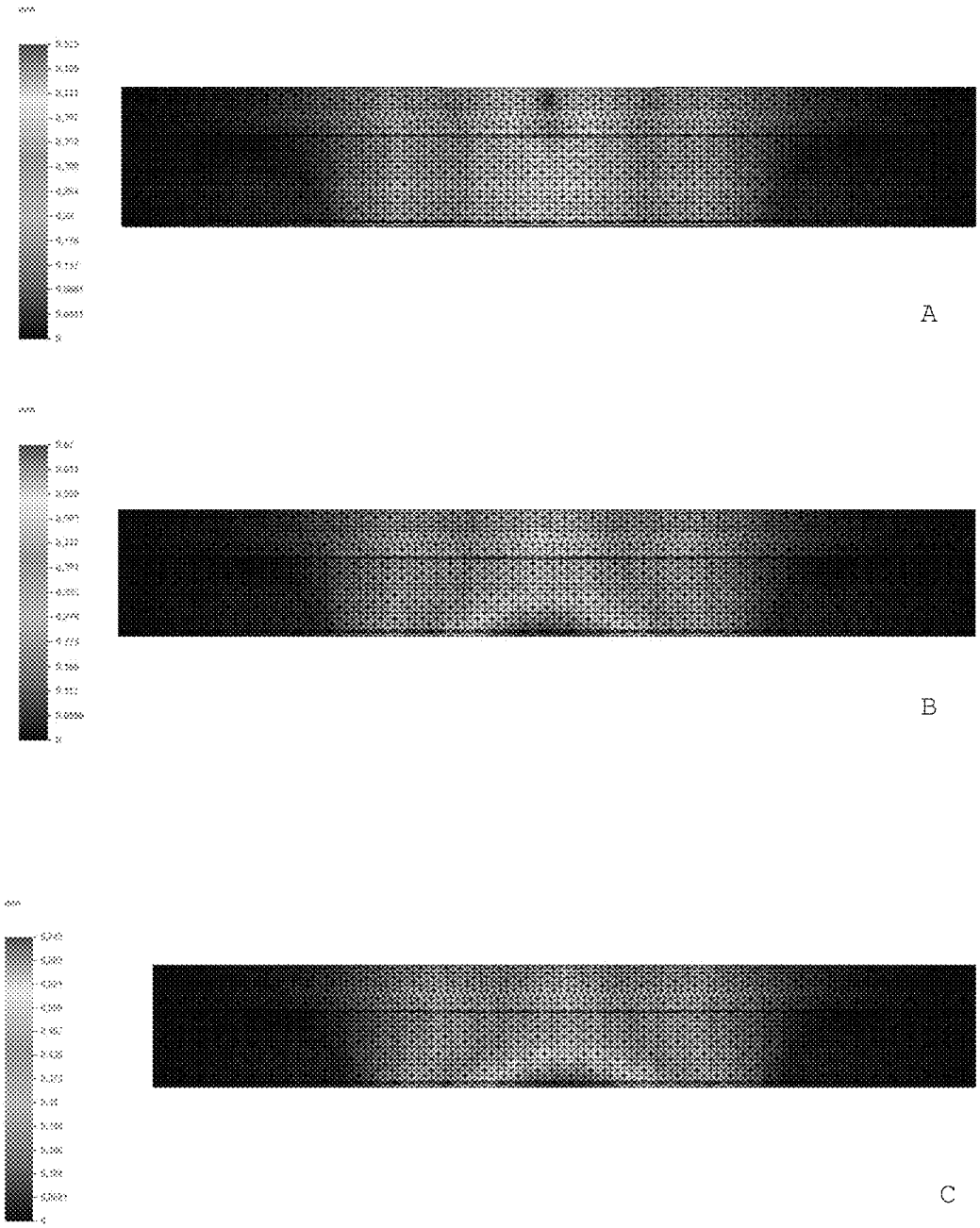
FIG. 9 shows the result of the simulations of the vertical loads with the maximum displacements in the TR68 rails (A), the double web rail (B) and the triple web rail (C)

From the analysis of the results presented in FIG. 8, a stress concentration in the load application region and a dissipation of this stress by the rail web can be noted. No significant stress variations were observed between the rails. Likewise, the displacements observed in FIG. 9 also did not have significant differences between the profiles, which were in the range of 0.52 mm to 0.74 mm.

Figure 10:
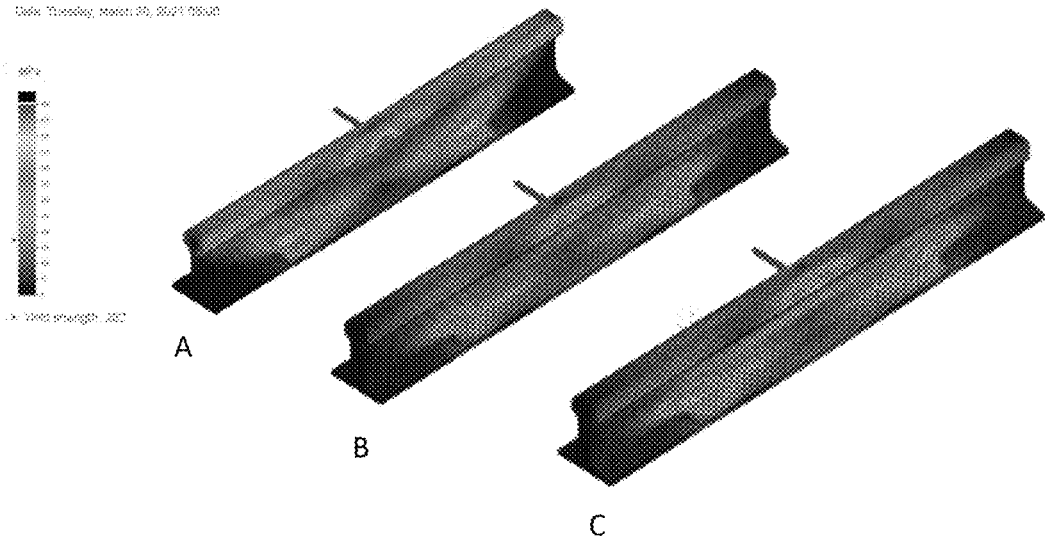
FIG. 10 shows the stress distribution in the cross section of the TR68, double web and triple web rails at the load application point.
Figure 11:
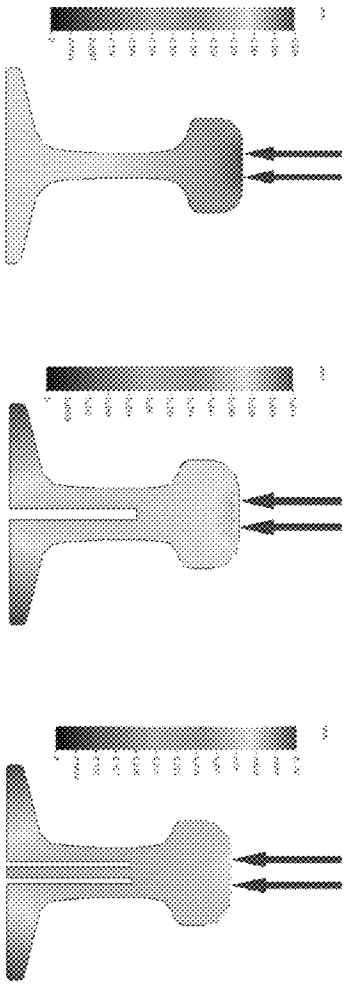
FIG. 11 shows the distribution of stresses generated by the vertical loading in the cross section of the TR68, double web and triple web rails at the load application point.
Figure 12:
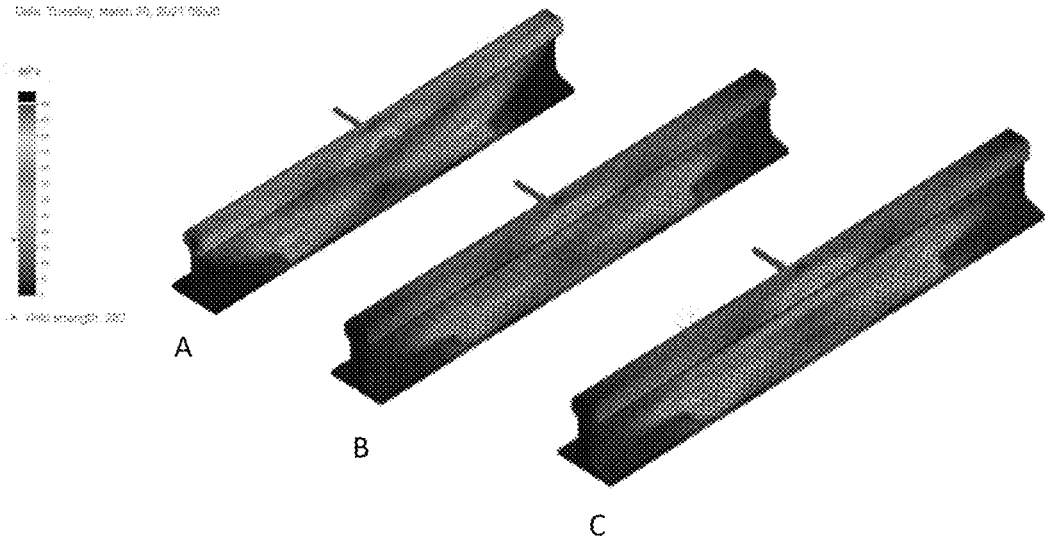
FIG. 12 shows the isometric view of the result of the simulations of horizontal loads with maximum stresses on the TR68 rails (A), the double web rail (B) and the triple web rail (C)

FIG. 10 and FIG. 11 present, respectively, the distribution of stresses and displacements in the cross section of the rail at the point of application of the load. There can be seen a change in the distribution of stresses and displacements, although with few significant differences between the profiles. Table 3 presents the comparisons of the maximum displacements.

TABLE 3

Comparisons of the maximum displacements.

| Profile | Maximum displacement (mm) | Variation (%) |
|---|---|---|
| TR68 | 0.553 | — |
| Double Rail | 0.671 | 121.34 |
| Triple Rail | 0.746 | 134.90 |

For the horizontal loadings, three rail profiles subjected to a horizontal load were simulated. The results were analyzed in terms of maximum stresses and strains and are presented below. As it is a comparative scenario between the profiles, the maximum admissible stresses of the material were not taken into account, since the purpose of the analysis is to comparatively evaluate the profiles.

Figure 13:
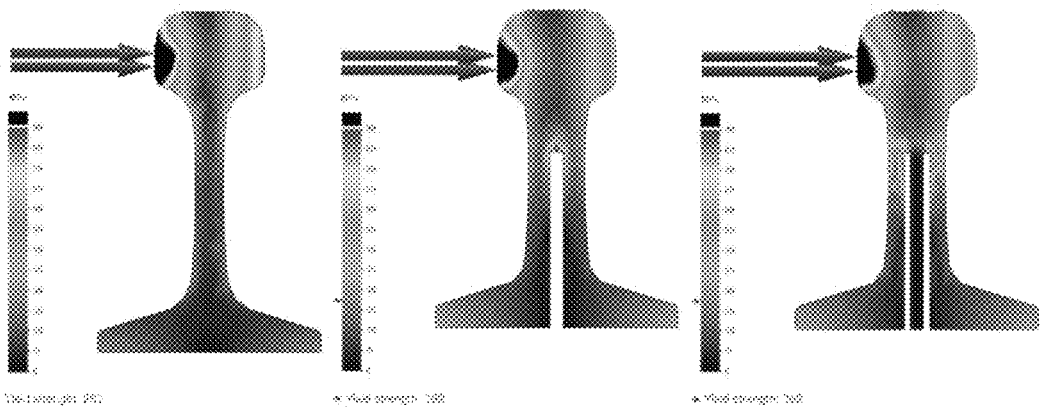
FIG. 13 shows the distribution of stresses generated by the horizontal loading in the cross section of the TR68, double web and triple web rails at the load application point.
Figure 14:
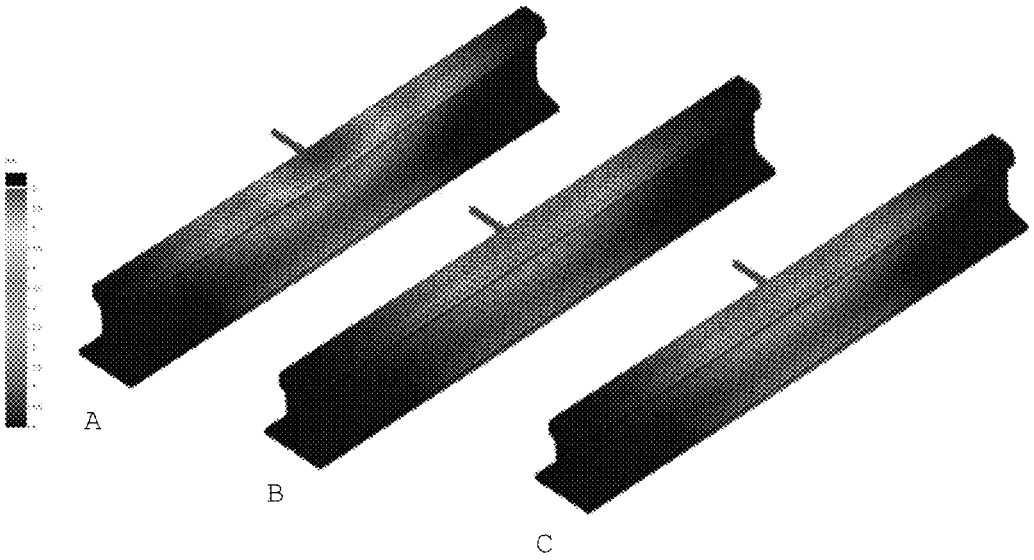
FIG. 14 shows the isometric view of the result of the simulations of the horizontal loads with the maximum displacements on the TR68 rails (A), the double web rail (B) and the triple web rail (C)
Figure 15:
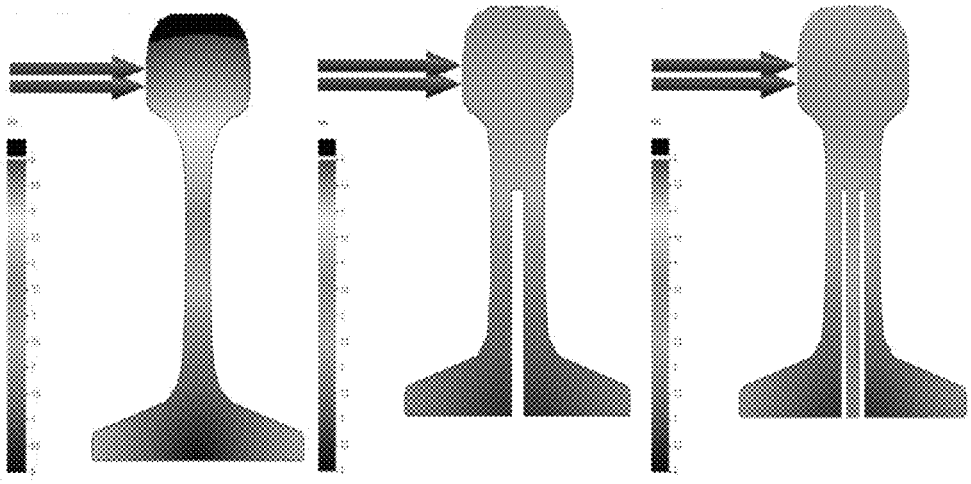
FIG. 15 shows the distribution of displacements generated by the horizontal loading in the cross section of TR68, double web and triple web rails at the point of load application.
Figure 16:
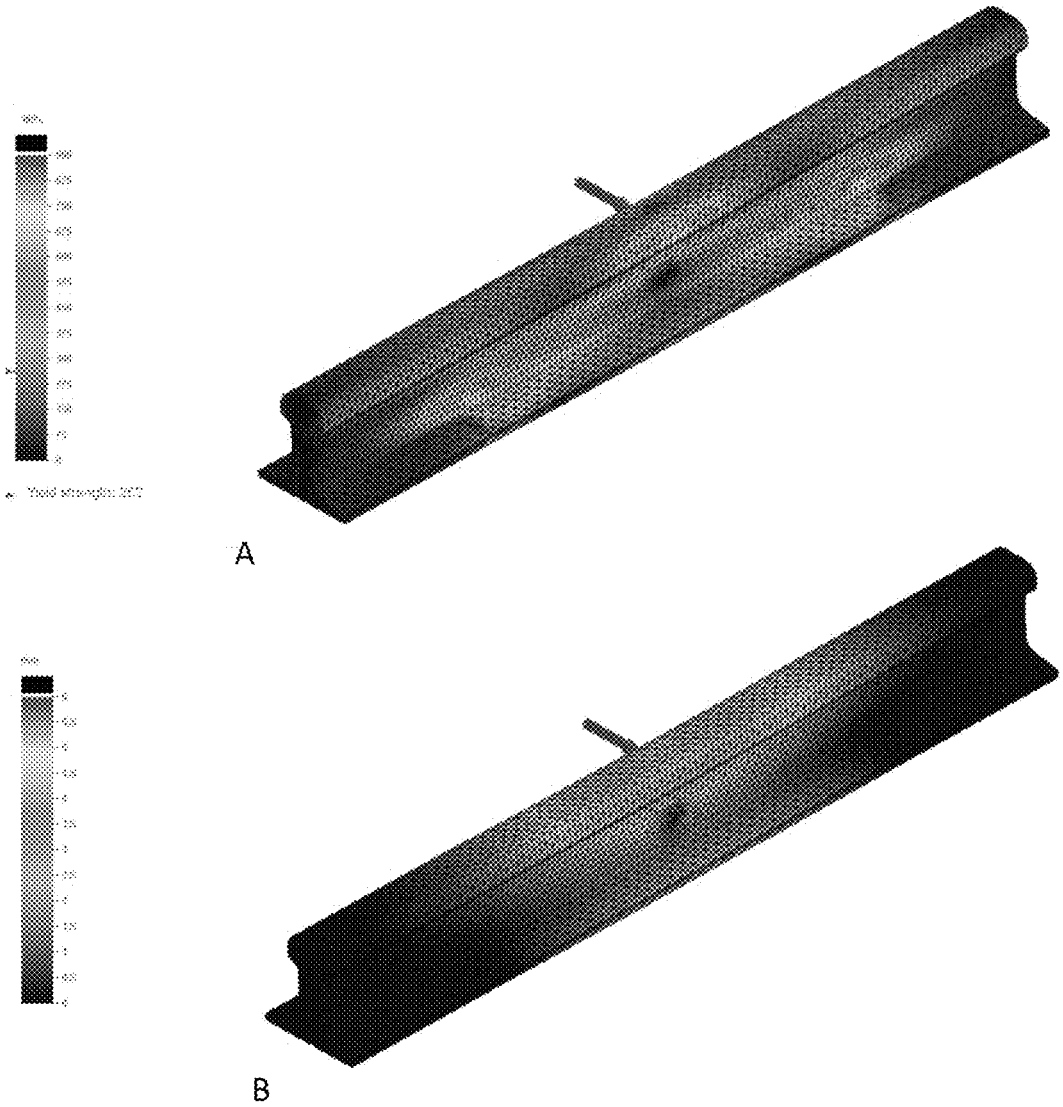
FIG. 16 shows the isometric view of the result of the simulations of the horizontal loads with the maximum stresses (A) and the maximum displacements (B) in the triple web rail with the presence of a hole in the web.
Figure 17:
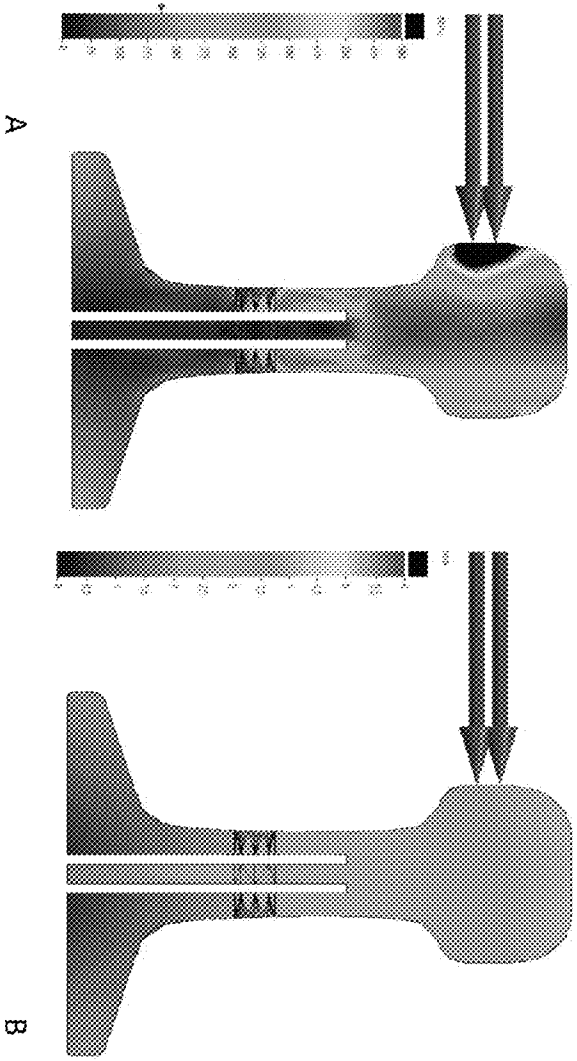
FIG. 17 shows the distribution of stresses (A) and displacements (B) generated by the horizontal loading in the cross section of triple web rails with the presence of a hole in the web.

FIG. 13 shows the stress distribution in the simulated profiles. It is observed that the double rail and the triple rail generated a reduction of the maximum stresses of the rail. Likewise, FIG. 14 shows a reduction in the displacement of the double and triple profile rails. Compared with the TR68 rail, the displacement presented in the double and triple rails were, respectively, 64.33% and 68.94% as shown in Table 4.

TABLE 4

Comparisons of the maximum displacements

| Profile | Maximum displacement (mm) | Variation (%) |
|---|---|---|
| TR68 | 6.24 | — |
| Double Rail | 3.77 | 60.42 |
| Triple Rail | 4.04 | 64.74 |

Double and triple profile rails with ¼" (6.35 mm) and ½" (12.7 mm) diameter holes were simulated for the passage of power and data cables. The same horizontal and vertical loads as in the previous cases were applied. FIG. 16 through FIG. 19 show the stress and displacement results for the ½" (12.7 mm) hole triple rail subjected to a horizontal load. Comparing with the results of the trail without the hole, there were no significant changes in the maximum values obtained. The same analysis can be observed for cases with a ¼" (6.35 mm) hole.

Figure 18:
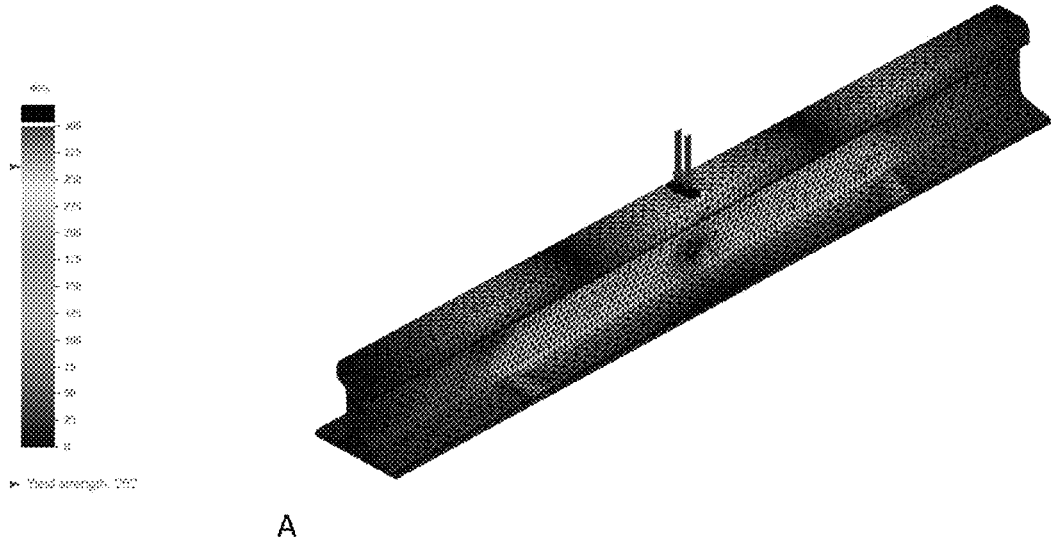
FIG. 18 shows the isometric view of the result of the simulations of the vertical loads with the maximum stresses (A) and the maximum displacements (B) in the triple web rail with the presence of a hole in the web.
Figure 18:
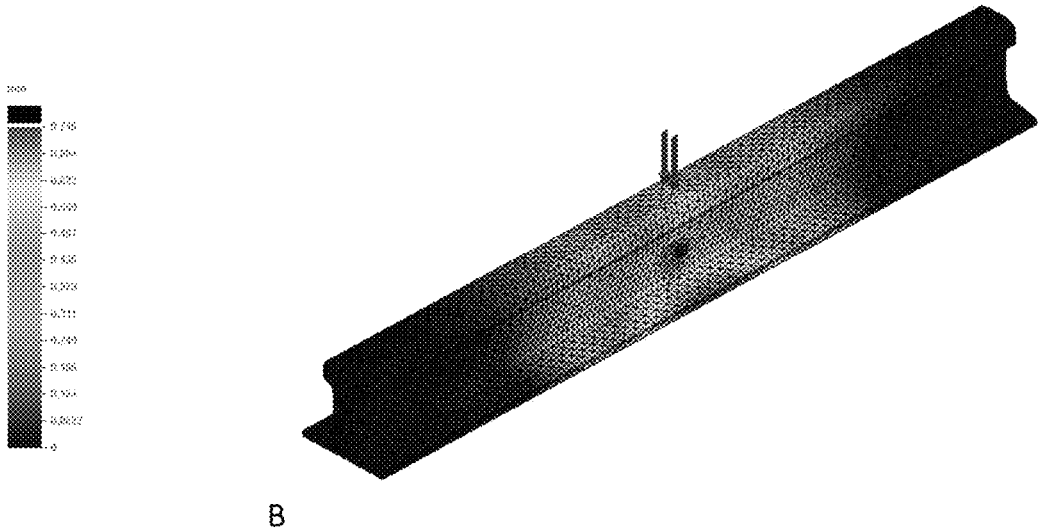
Figure 19:
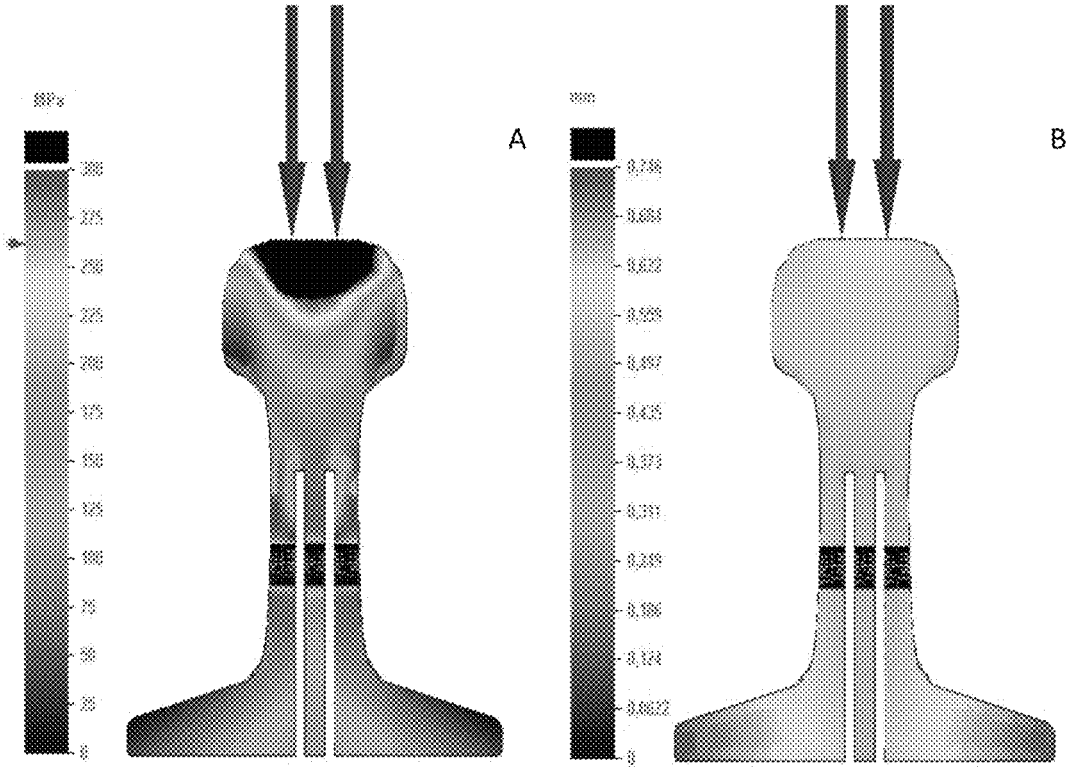
FIG. 19 shows the distribution of stresses (A) and displacements (B) generated by the vertical loading in the cross section of triple web rails with a hole in the web.

FIG. 18 stress and presents the displacement results for the triple rail with a ½" (12.7 mm) hole subjected to a vertical load. Also, no changes were observed in stresses and displacements for both the ¼" (6.35 mm) and ½" (12.7 mm) holes. It is observed that the insertion of punctual holes in the rails does not affect the global behavior of the system.

The simulation presented a comparative analysis of three train rails subjected to vertical and horizontal loading, where the maximum stresses and maximum displacements of the rails were comparatively evaluated.

It is observed that both the double rail and the triple rail present a stress reduction of approximately 22% and displacement reduction of approximately 32% when subjected to a horizontal load. As for the vertical load, the rails showed similar behavior.

Table 5 shows the dimension values of the different models of Vignole rails compared to the dimensions of a version of the double and triple web rails.

| Standard model | Head - width (mm) | Web - thickness (mm) | Foot - width (mm) | Total height (mm) | Weight per meter (kg/m) | Cross-section area ($cm^2$) |
|---|---|---|---|---|---|---|
| TR 37 | 62.72 | 13.49 | 122.24 | 122.24 | 37.20 | 47.39 |
| TR 45 | 65.09 | 14.29 | 130.18 | 142.88 | 44.65 | 56.90 |
| TR 50 | 68.26 | 14.29 | 136.52 | 152.40 | 50.35 | 64.19 |
| TR 57 | 69.05 | 15.88 | 139.70 | 168.28 | 56.90 | 72.56 |
| UIC 60 | 72.00 | 16.50 | 150.00 | 172.00 | 60.21 | 76.70 |
| GB 60 | 73.00 | 16.50 | 150.00 | 176.00 | 60.64 | 77.47 |
| TR 68 | 74.61 | 17.46 | 152.40 | 185.73 | 67.41 | 86.52 |
| DOUBLE WEB | 74.61 | X = 8.00 $W_1 = W_2 =$ 13.71 or $X + (W_1 + W_2) <$ Head Width | 152.40 | 159.54 | 67.41 | 86.52 |
| TRIPLE WEB | 74.61 | Y = 4.00 $W_1 = W_3 = 9.71$ and $W_2 = 8.00$ or $2*Y + (W_1 + W_2 + W_3) <$ Head Width | 152.40 | 159.54 | 67.41 | 86.52 |
| 140RE | 76.20 | 19.05 | 152.40 | 185.68 | 69.50 | 88.09 |
| 141RE | 77.79 | 17.46 | 152.40 | 188.91 | 69.79 | 88.38 |

The invention claimed is:

1. A railroad rail comprising:

a foot;

a triple web; and a head;

wherein the triple web comprises at least a first external wall, a central wall, and a second external wall, wherein the first external wall has a first external surface and a first internal surface, which define a first thickness;

wherein the second external wall has a second external surface and a second internal surface, which define a second thickness;

wherein the central wall has a third internal surface and a fourth internal surface, which define a third thickness;

wherein the first and second external surfaces, and the first, second, third, and fourth internal surfaces are parallel;

wherein the first internal surface of the first external wall, and the central wall, are separated by a first distance that is smaller the first, second, and third thicknesses;

wherein the second internal surface of the second external wall, and the central wall, are separated by a second distance that is smaller than the first, second, and third thicknesses;

wherein the foot comprises a first side branch portion extending from a first lower end of the first external wall and a second side branch portion extending from a second lower end of the second external wall, wherein the first side branch portion and the second side branch portion extend in opposite directions;

wherein the head comprises a single element joined to respective upper ends of the first external wall, the central wall, and the second external wall.

2. The railroad rail according to claim 1, wherein a central lower end surface of the central wall is flush with a first lower end surface of the first side branch portion and with a second lower end surface of the second side branch portion.

3. The railroad rail according to claim 1, wherein each of the first external wall, the central wall, and the second external wall comprises a respective plurality of holes, each respective plurality of holes including at least a respective first hole that has a first shape and a respective second hole that has a second shape different from the first hole, wherein all of the first holes are aligned on a first axis and all of the second holes are aligned on a second axis.

4. The railroad rail according to claim 3, wherein each respective plurality of holes further includes a third hole, wherein all of the third holes are not aligned on a same axis.

5. The railroad rail according to claim 4, wherein at least one of the first, second, and third holes is one of a circle, an oblong shape, an ellipsoid shape, or a rectangle with rounded corners.

6. The railroad rail according to claim 4, wherein the first holes, the second holes, and the third holes have a geometric shape.

7. The railroad rail according to claim 3, wherein at least one of each respective plurality of holes is adapted to receive one of a cable or a wire.

8. The railroad rail according to claim 3, wherein each respective plurality of holes includes respective holes located along an entire length of the railroad rail.

9. The railroad rail according to claim 1, wherein the first thickness of the first external wall, the second thickness of the second external wall, and the third thickness of the central wall are equal.

10. The railroad rail according to claim 1, wherein the first thickness of the first external wall and the second thickness of the second external wall are different.

11. The railroad rail according to claim 10, wherein the third thickness of the central wall is different from the first thickness of the first external wall and different from the second thickness of the second external wall.

12. The railroad rail according to claim 1, wherein the foot, the triple web, and the head extend along an entire length of the railroad rail.

13. The railroad rail according to claim 1, wherein the first external wall comprises at least a first hole, the central wall comprises at least a second hole, and the second external wall comprises at least a third hole, wherein the first, second and third holes are aligned along an axis.

14. The railroad rail according to claim 13, wherein the first, second, and third holes are aligned along a first axis that is oblique with respect to a second axis of the railroad rail.

15. The railroad rail according to claim 1, wherein the first external wall comprises one or more first holes, the central wall comprises one or more second holes, and the second external wall comprises one or more third holes, wherein the one or more first holes, the one or more second holes, and the one or more third holes have a same shape.

16. The railroad rail according to claim 1, wherein the first external wall has no holes, the central wall has no holes, and the second external wall has no holes.

17. A railroad rail comprising:

a foot;

a double web; and a head;

wherein the double web comprises at least a first external wall and a second external wall, wherein the first external wall has a first external surface and a first internal surface, which define a first thickness;

wherein the second external wall has a second external surface and a second internal surface, which define a second thickness;

wherein the first external surface, the second external surface, the first internal surface, and the second internal surface are parallel;

wherein the foot comprises a first side branch portion extending from a first lower end of the first external wall and a second side branch portion extending from a second lower end of the second external wall, wherein the first side branch portion and the second side branch portion extend in opposite directions;

wherein the head comprises a single element joined to respective upper ends of the first external wall and the second external wall, and wherein each of the first external wall and the second external wall comprises a respective plurality of holes, each respective plurality of holes including at least a respective first hole that has a first shape and a respective second hole that has a second shape different from the first hole, wherein the first holes are aligned on a first axis and the second holes are aligned on a second axis.

18. The railroad rail according to claim 17, wherein the first thickness and the second thickness are equal.

19. The railroad rail according to claim 17, wherein the first thickness and the second thickness are different.

20. The railroad rail according to claim 17, wherein each respective plurality of holes further includes a respective third hole, wherein the respective first hole, the respective second hole, and the respective third hole are aligned along a third axis that is not perpendicular to a fourth axis of the railroad rail.

21. The railroad rail according to claim 20, wherein at least one of the first, second, and third holes is one of a circle, an oblong shape, an ellipsoid shape, or a rectangle with rounded corners.

22. The railroad rail according to claim 17, wherein at least one of each respective plurality of holes is adapted to receive one of a cable or a wire.

23. The railroad rail according to claim 17, wherein each respective plurality of holes includes respective holes located along an entire length of the railroad rail.

24. The railroad rail according to claim 17, wherein the foot, the double web, and the head extend along an entire length of the railroad rail.

25. The railroad rail according to claim 17, wherein the first external wall comprises at least a first hole and the second external wall comprises at least a second hole, wherein the first and second holes are aligned along an axis.

26. The railroad rail according to claim 25, wherein the first and second holes are aligned along a first axis that is oblique with respect to a second axis of the railroad rail.

27. The railroad rail according to claim 17, wherein the first external wall comprises one or more first holes and the second external wall comprises one or more second holes, wherein the one or more first holes and the one or more second holes have a same shape.

28. The railroad rail according to claim 17, wherein the first external wall has no holes and the second external wall has no holes.

29. The railroad rail according to claim 17, wherein the first holes and the second holes have a geometric shape.

* * * * *